US006447303B1

(12) United States Patent
Kihira et al.

(10) Patent No.: US 6,447,303 B1
(45) Date of Patent: Sep. 10, 2002

(54) COMMUNICATION MODULE CONNECTOR

(75) Inventors: Satoru Kihira; Masaaki Harasawa; Shoichi Takada, all of Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/985,829

(22) Filed: Nov. 6, 2001

(30) Foreign Application Priority Data

Dec. 27, 2000 (JP) ..... 2000-397215

(51) Int. Cl.[7] ..... H01R 12/00
(52) U.S. Cl. ..... 439/63; 439/76.1
(58) Field of Search ..... 439/63, 76.1, 578, 439/607, 66

(56) References Cited

U.S. PATENT DOCUMENTS 4,603,320 A * 7/1986 Farago ..... 341/100
4,603,926 A * 8/1986 Nesbit et al. ..... 439/581
4,993,956 A * 2/1991 Pickles et al. ..... 439/620
5,364,280 A * 11/1994 Colleran ..... 439/76.1
5,454,734 A * 10/1995 Eggert et al. ..... 439/578
6,296,514 B1 * 10/2001 Medina et al. ..... 439/404

* cited by examiner

*Primary Examiner*—Tulsidas Patel
(74) *Attorney, Agent, or Firm*—Rader, Fishman, & Grauer, PLLC

(57) ABSTRACT

A connector is disclosed which is to be used for mounting, on an assembled circuit board, a communication module having a high frequency circuit mounted thereon. This connector has a connector body to be mounted on the assembled circuit board, contact members, and a high-frequency-signal connector-element mounting portion) for mounting a high-frequency-signal connector element. The connector body has a mounting space on which the communication module is mounted, and there is disposed a cover member for opening and closing at least a portion of the mounting space.

16 Claims, 10 Drawing Sheets

COMMUNICATION MODULE CONNECTOR

BACKGROUND OF THE INVENTION

1. Field of the Invention

The present invention relates to a communication module connector to be used for mounting a communication module represented by a bluetooth transmission/reception module, on an assembled circuit board of any of a variety of apparatus.

2. Description of Related Art

The bluetooth is a short-distance communication technology for which standardization has been started in May 1998 by five companies, i.e., Ericsson, IBM, Intel, Nokia and Toshiba. This is used for communicating, in radio, audio data or asynchronous data in a short distance of about 10 m.

To achieve such a short-distance communication technology, it is required to mount a blue tooth communication module (transmission/reception module) on apparatus which participates in communication, such as a cellular phone, a notebook computer, a digital household electrical appliance and equipment, or the like.

A bluetooth communication module has, for example, a connector portion used for connection with an assembled circuit board of such apparatus. When this connector portion is connected to a connector portion disposed on the assembled circuit board of the apparatus, the apparatus is electrically connected to the bluetooth communication module.

Examples of the bluetooth communication module include a module incorporating an antenna for radio communication, and a module incorporating no antenna but having a coaxial connector for connection with an external antenna. The antenna-incorporating module has, as an external connection, only a connector portion for communicating a signal with the assembled circuit board. On the other hand, the module arranged to use an external antenna, has not only a signal connector portion for communication with the assembled circuit board, but also a coaxial connector for a radio frequency band. The assembled circuit board also has a coaxial connector. Communication of a high frequency signal between the communication module and the assembled circuit board, is achieved through a dedicated cable provided at both ends thereof with coaxial connectors to be respectively fitted to the coaxial connector of the communication module and the coaxial connector of the assembled circuit board.

According to the connection structure above-mentioned, a connector portion is disposed at the bluetooth communication module, and a connector portion to be fitted to this first-mentioned connector portion is mounted on the assembled circuit board of the apparatus. However, there are instances where different manufacturers respectively produce a bluetooth communication module, apparatus on which this communication module is mounted, and connectors for connecting the communication module and the apparatus to each other. In such a case, the connector manufacturer is required to supply, respectively, one of a pair of connector portions to be fitted to each other, to the communication module manufacturer and the other to the apparatus manufacturer. This makes not only handling but also quality control difficult.

The above problem is also applied to coaxial connectors. Further, a coaxial connector disposed at a communication module is very small. This makes it difficult to fit a coaxial connector of a dedicated cable to the coaxial connector of the communication module. Further, such a dedicated cable is disadvantageously very expensive.

SUMMARY OF THE INVENTION

It is an object of the present invention to provide a communication module connector easy to handle.

The present invention relates to a connector (10) to be used for mounting, on an assembled circuit board, a communication module (100) having a high frequency circuit (102) mounted thereon. This connector comprises: a connector body (1) to be mounted on an assembled circuit board; contact members (2) disposed on the connector body and having contacts (21) which come in resilient contact with the terminals of the communication module, and connection portions (22) which are electrically connected to the assembled circuit board; and a high-frequency-signal connector-element mounting portion (19) disposed at the connector body for mounting a high-frequency-signal connector element (7).

Numerals and alphabets in parentheses refer to corresponding component elements in the embodiments to be discussed later. However, it is a matter of course that the present invention should not be construed as limited to these embodiments. This is also applied to the following description.

The communication module may be a bluetooth transmission/reception module.

The communication module may have, on the surface of a circuit board (101), metallic pads (103) serving as the terminals above-mentioned.

According to the present invention, the connector body to be mounted on an assembled circuit board, has contact members to be connected to a communication module, and these contact members are arranged to be electrically connected to the assembled circuit board. Accordingly, for example when the terminals formed by metallic pads or the like on the surface of the circuit board as a component element of the communication module, come in resilient contact with the contact members, the communication module can be electrically connected to the assembled circuit board. According to such a connection mode, a connector element is not required to be disposed at the communication module side. This not only simplifies the arrangement of the communication module, but also facilitates the handling of the connector. Further, the connector is solely attached at the side of the assembled circuit board. This is also advantageous in view of the quality control of the connector.

Further, the communication module connector of the present invention has a high-frequency-signal connector-element mounting portion, and provision is made such that a high-frequency-signal connector element can be mounted, as necessary, on this high-frequency-signal connector-element mounting portion. Accordingly, when such a high-frequency-signal connector element has been mounted, this achieves both electric connection for an ordinary signal (having low frequency as compared with a high frequency signal), and electric connection for a high frequency signal (e.g., signal of a radio frequency band).

It is preferable that the connector body has a mounting space (3) on which the communication module is to be mounted, and that the connector further comprises a cover member (5) for opening and closing at least a portion of the mounting space.

According to the arrangement above-mentioned, when a communication module is mounted on the module mounting space and the cover member is closed, the communication module can securely be held, and the resilient contact between the communication module and the contact members can securely be held.

Preferably, a locking mechanism (locking pawl or the like) (54*a*, 56*a*) is disposed at the cover member and/or the connector body for keeping the cover member in the closing state.

It is preferable that the cover member is rotatably attached to one end of the connector body for regulating one end portion of the communication module within the mounting space, and that there is formed, at the other end of the connector body opposite to the one end, a regulating member (4) arranged to engage with the other end portion of the communication module opposite to the one end portion, there by to regulate the other end portion of the communication module within the mounting space.

According to the arrangement above-mentioned, when the communication module is housed in the mounting space with the other end portion of the communication module regulated by the regulating member, and the cover member is closed, the communication module can securely be held in the mounting space of the connector body. Accordingly, even though a shock is given to the apparatus on which the communication module has been mounted, the communication module cannot get out of the connector, thus securely holding the electric connection between the communication module and the assembled circuit board of the apparatus.

It is preferable that the high-frequency-signal connector-element mounting portion is disposed at the one end of the connector body, and that the contact members are disposed at the other end of the connector body.

According to the arrangement above-mentioned, the one end of the connector body is regulated by the cover member. It is therefore possible to securely connect the high-frequency-signal connector element and the communication module to each other. Further, the other end of the communication module is regulated by the regulating member. This securely holds the electric connection between the contact members and the terminals of the communication module.

Preferably, the cover member is made of metal. In such a case, noise shielding can be achieved by the cover member. In particular, when the high-frequency-signal connector-element mounting portion is disposed so as to be covered with the cover member, this effectively prevents noise from entering into a high frequency signal transmission passage through the high-frequency-signal connector part, and into a high frequency circuit in the vicinity thereof.

To obtain a good noise shielding effect, the connector of the present invention preferably further comprises a noise-shielding connection member (6) arranged to connect the cover member to a low-impedance portion (a power supply portion or ground portion, for example) of the assembled circuit board when the cover member is closed.

Further, when an extension portion (54~57, 59, 60) for laterally covering a portion of the mounting space, is formed at the lateral side of the cover member, the noise shielding effect can be increased.

Preferably, the cover member has a spring piece (58) to be pressingly contacted with the communication module (in particular, the outer surface of the heat generating portion; e.g., the outer surface in the vicinity of the high frequency circuit).

According to the arrangement above-mentioned, heat generated from circuit elements in the communication module, can be radiated through the spring piece (e.g., integral with the cover member and made of metal).

Preferably, the connector of the present invention further comprises a heat transfer member (6) attached to said connector body, this heat transfer member being arranged to be pressingly contacted with the cover member and to be joined to the assembled circuit board to form a heat radiating passage thereto when the cover member is closed.

According to the arrangement above-mentioned, heat generated in the communication module passes through the metallic cover member via the spring piece, and is then transmitted to the assembled circuit board through the heat transfer member (which may also serve as the noise-shielding connection member). This effectively prevents the communication module from being excessively heated.

Preferably, the connector further comprises amounting aid member (51, 52) which is disposed at the rotational base end of the cover member, which comes in contact with one end of the communication module at the time of operations of mounting the same on the mounting space, and which causes the cover member to be rotated in the closing direction when the communication module is pushed into the mounting space.

According to the arrangement above-mentioned, when the communication module is mounted, this causes the cover member to be rotated in the closing direction. This facilitates the mounting of the communication module. For example, the communication module can be mounted on the connector body with one hand.

Preferably, the connector further comprises a switch member (9) disposed at the connector body and arranged to be made or opened dependent on the installation of the communication module.

According to the arrangement above-mentioned, whether or not the communication module is being mounted on the connector body, can be detected by monitoring the conduction/non-conduction of the switch member.

The switch member is to be electrically connected to the assembled circuit board of the apparatus. Such electric connection may be achieved by solder-joining the switch member terminals (91, 92) to the assembled circuit board. Alternately, portions out of the contact members may be used for electrical connection between the switch member and the assembled circuit board.

Preferably, the connector above-mentioned further comprises a high-frequency-signal connector element (7) mounted on the high-frequency-signal connector-element mounting portion and arranged to come in resilient contact with a high-frequency-signal terminal portion (104) of the communication module.

According to the arrangement above-mentioned, the high-frequency-signal connector element is mounted on the high-frequency-signal connector-element mounting portion. It is therefore possible to communicate, between the connector and the communication module, not only a signal of an ordinary frequency band, but also a high frequency signal of a radio frequency band for example.

Provision is made such that the high-frequency-signal connector element comes in resilient contact with the high-frequency-signal terminal portion of the communication module. Therefore, no connector element for a high frequency signal is required to be disposed at the side of the communication module. More specifically, the high-frequency-signal terminal portion of the communication module can be made in the form of metallic pads (105, 106)

formed on the circuit board, and when the high-frequency-signal connector element comes in resilient contact with such terminal portion, a high frequency signal transmission passage is formed.

Accordingly, even though the communication module is, for example, of the type using an external antenna, a high-frequency-signal connector element is not required to be disposed on the communication module. This not only simplifies the arrangement of the communication module, but also lowers the cost thereof. Further, provision is made such that the high-frequency-signal connector element is pressingly contacted with the high-frequency-signal terminal portion of the communication module. This advantageously saves the trouble of fitting the connector parts to each other.

Further, when the high-frequency-signal connector element is arranged to be solder-joined to the assembled circuit board of the apparatus, this eliminates the need of using an expensive dedicated cable.

Preferably, the high-frequency-signal connector element comprises: a ground contact (72) arranged to come in contact with a ground portion (106) of the high-frequency-signal terminal portion; a signal contact (71) arranged to come in contact with a signal portion (105) of the high-frequency-signal terminal portion; a ground contact biasing member (77) for resiliently biasing the ground contact to the ground portion of the high-frequency-signal terminal portion; and a signal contact biasing member (73) for resiliently biasing the signal contact to the signal portion of the high-frequency-signal terminal portion.

According to the arrangement above-mentioned, the ground contact and the signal contact are respectively resiliently biased to the signal portion and the ground portion of the communication module. Accordingly, a good high frequency signal transmission passage is formed between the high-frequency-signal connector element and the communication module.

These and other features, objects, advantages and effects of the present invention will be more fully apparent from the following detailed description set forth below when taken in conjunction with the accompanying drawings.

DESCRIPTION OF THE PREFERRED EMBODIMENTS

Figure 1:
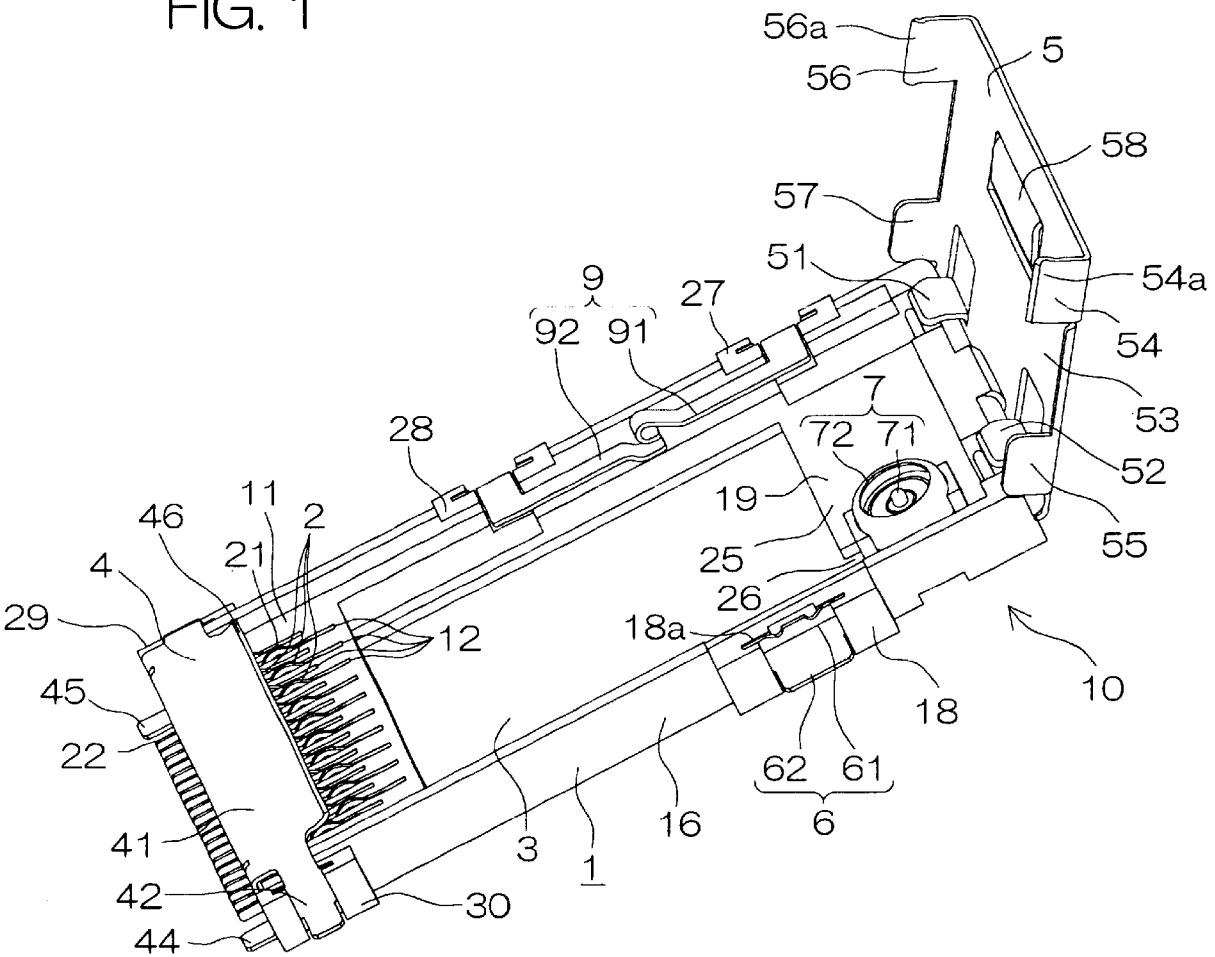
FIG. 1 is a perspective view of a communication module connector according to an embodiment of the present invention.
Figure 2:
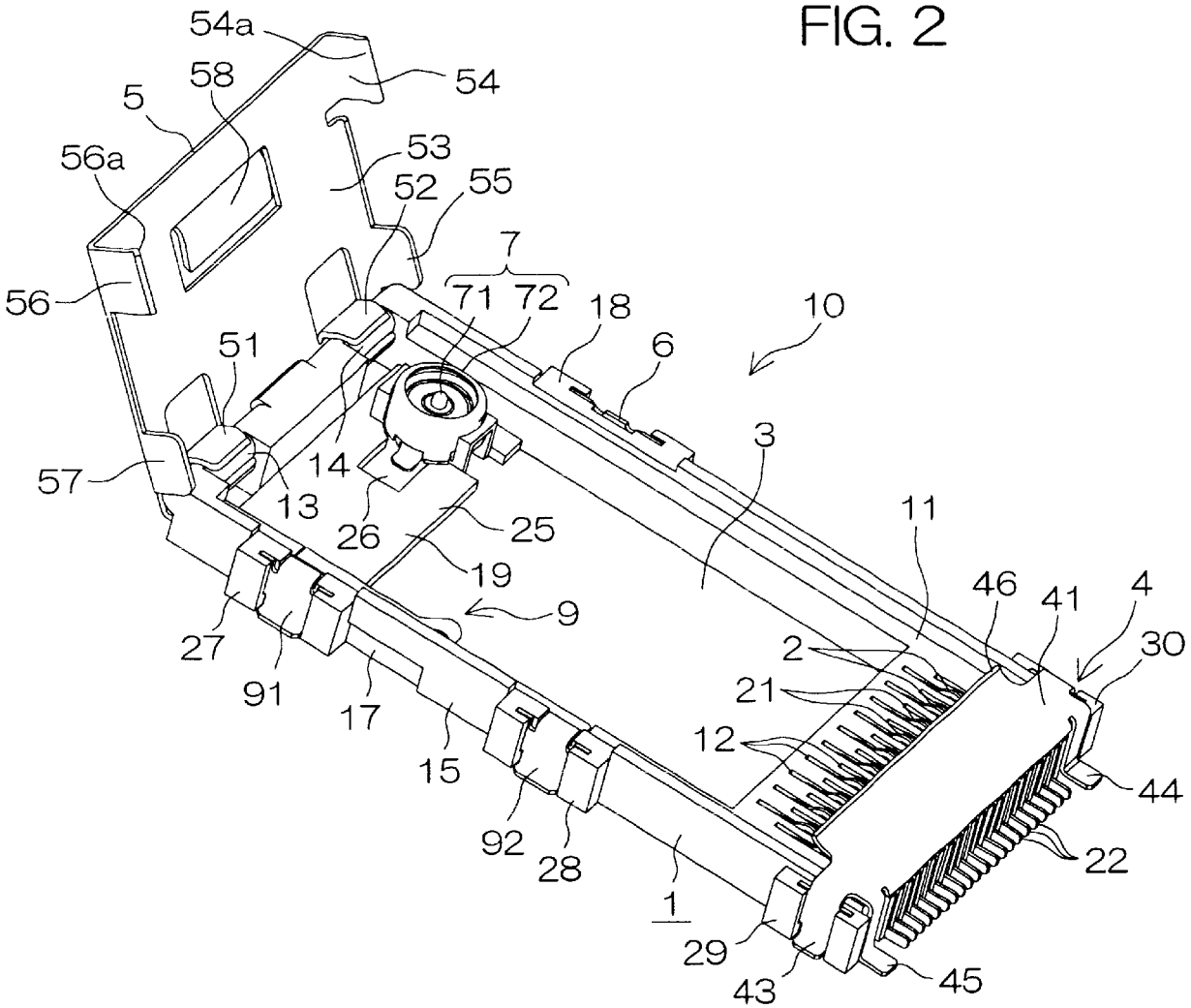
FIG. 2 is a perspective view of the communication module connector in FIG. 1, as rotated by an angle of about 180° around the perpendicular axis of FIG. 1.

FIG. 1 is a perspective view of a communication module connector 10 according to an embodiment of the present invention, and FIG. 2 is a perspective view of the communication module connector 10 in FIG. 1, as rotated by an angle of about 180° around the perpendicular axis of FIG. 1. This communication module connector 10 is used for mounting a communication module such as a bluetooth transmission/reception module or the like, on the assembled circuit board of apparatus such as a cellular phone, a notebook computer, a digital household electric appliance and equipment, or the like.

The connector 10 has a connector body 1 to be mounted on the assembled circuit board of the apparatus, and a cover member 5 openably connected to the connector body 1. The connector body 1 is composed of a molded article of a synthetic resin material, and is made in a substantially rectangular flame-like form in plan view. A plurality of contact members 2 made of a resilient metallic material are disposed in the vicinity of one shorter side of the connector body 1.

Each of the contact members 2 has a contact 21 projecting from a bottom surface 11 defining a module mounting space 3 inside of the connector body 1, and a connection portion 22 joined to the contact 21 and projecting along the longitudinal direction of the connector body 1 in the vicinity of the one shorter side of the connector body 1. The connection portions 22 are disposed so as to be positioned substantially in the same plane as the bottom surface (surface opposite to the assembled circuit board of the apparatus) of the connector body 1. The connection portions 22 are to be solder-joined to the assembled circuit board of the apparatus.

The contacts 21 are respectively fitted in slits 12 formed in the bottom surface 11 and project substantially in the form of a circular arc above the bottom surface 11. The slits 12 are parallel to one another and extend in the longitudinal direction of the connector body 1. The lengths, of adjacent slits 12, in the longitudinal direction of the connector body 1 are different from each other by a predetermined value. Accordingly, the contacts 21 of adjacent contact members 2 are different from each other in projecting position along the longitudinal direction of the connector body 1, such that the whole contacts 21 are disposed in so-called zigzags.

The connector body 1 is provided at the shorter side thereof at the side of the contact members 2 with a regulating member 4 for regulating one end of a communication module to be mounted on the module mounting space 3. More specifically, the regulating member 4 is attached as pressed into press-fit portions 29, 30 formed at both lateral sides 15, 16 of the connector body 1. Accordingly formed at one end of the module mounting space 3 is a shell having a substantially U-shape section for receiving the one end of the communication module.

According to this embodiment, the regulating member 4 is made of a metallic material, and has (i) a plate-like regulating portion 41 to be positioned on the one end of a communication module mounted on the module mounting space 3, (ii) hanging portions 42, 43 which hang down, from both ends of the regulating portion 41, along the lateral sides 16, 15, respectively, of the connector body 1, and (iii)

another hanging portions 44, 45 which hang down, in the vicinity of both ends of the regulating portion 41, along the end surface of the connector body 1. The tip of each of the hanging portions 42~45 is bent in the form of an L shape so as to follow the assembled circuit board of the apparatus. That is, these tips are to be solder-joined to the assembled circuit board.

At the shorter side opposite to the contact members 2 of the connector body 1, there are formed a pair of cover-member mounting shafts 13, 14 to which the cover member 5 is rotatably joined. The cover-member mounting shafts 13, 14 are formed, with a space provided therebetween, along the shorter side of the connector body 1. Rotational mounting portions 51, 52 of the cover member 5 are rotatably engaged with the cover-member mounting shafts 13, 14, respectively.

The cover member 5 is formed by machining a metallic plate, and has (i) a main body 53 for covering a portion of the module mounting space 3 of the connector body 1, (ii) the above-mentioned rotational mounting portions 51, 52 formed by cutting, raising and shaping portions of the rotational end of the main body 53, and (iii) two pairs of hanging portions (reinforcing tabs) 54, 55; 56, 57 formed, with a space provided therebetween, at the lateral sides of the main body 53. The hanging portions 54–57 will hang down along the lateral sides of the connector body 1 when the cover member 5 is rotated, from the state shown in FIGS. 1 and 2, to a closing position where a portion of the module mounting space 3 is closed.

Locking portions 54*a*, 56*a* for keeping the closing state of the cover member 5, are disposed at the tips of the hanging portions 54, 56, out of the hanging portions 54~57, which are located in positions near the center portion of the module mounting space 3 when the cover member 5 is closed. When the cover member 5 is closed, these locking portions 54*a*, 56*a* project toward the module mounting space 3 and form cylindrical curved surfaces along the longitudinal direction of the connector body 1.

The connector body 1 is provided in one lateral side 15 thereof with a locking recess portion 17 with which the locking portion 56*a* is engaged. Further, the connector body 1 is provided in the other lateral side 16 thereof with a heat-transfer-member press-fit portion 18 located at a position corresponding to the hanging portion 54. This heat-transfer-member press-fit portion 18 is opened toward the outside of the module mounting space 3. The heat-transfer-member press-fit portion 18 has a press-fit groove 18*a*, into which a heat transfer member 6 made of a metallic material is pressed. This heat transfer member 6 has a step portion 61 concaved toward the module mounting space 3 so as to be engaged with the locking portion 54*a*, and a joint portion 62 of which lower portion is formed in an L shape and is to be solder-joined to the assembled circuit board. When the cover member 5 is rotated to come close to the connector body 1 and then brought to the closing position, the locking portion 56*a* is engaged with the locking recess portion 17 and the locking portion 54*a* is engaged with the step portion 61 of the heat transfer member 6, thus causing the cover member 5 to be locked at the closing state.

When the cover member 5 is in the closing position, the locking portion 54*a* resiliently comes in contact with the heat transfer member 6. Accordingly, heat from the cover member 5 is radiated to the assembled circuit board through the heat transfer member 6. The joint portion 62 is solder-joined to a metallic portion of the assembled circuit board, e.g., a wide wiring pattern serving as ground potential.

The cover member 5 is provided in the vicinity of the end thereof opposite to the rotational mounting portions 51, 52 with a heat radiating tongue piece 58 formed by cutting and raising a portion of the main body 53. This heat radiating tongue piece 58 is resilient and has a substantially cylindrical curved face projecting toward the inside of the module mounting space 3 when the cover member 5 is closed. The heat radiating tongue piece 58 resiliently comes in contact with a communication module mounted on the module mounting space 3. Accordingly, heat generated in the communication module is transmitted to the heat radiating tongue piece 58 and then radiated to the air through the main body 53. Further, the heat generated in the communication module is transmitted to the assembled circuit board through the hanging portion 54 and the heat transfer member 6, thus causing the heat to be radiated.

Figure 6:
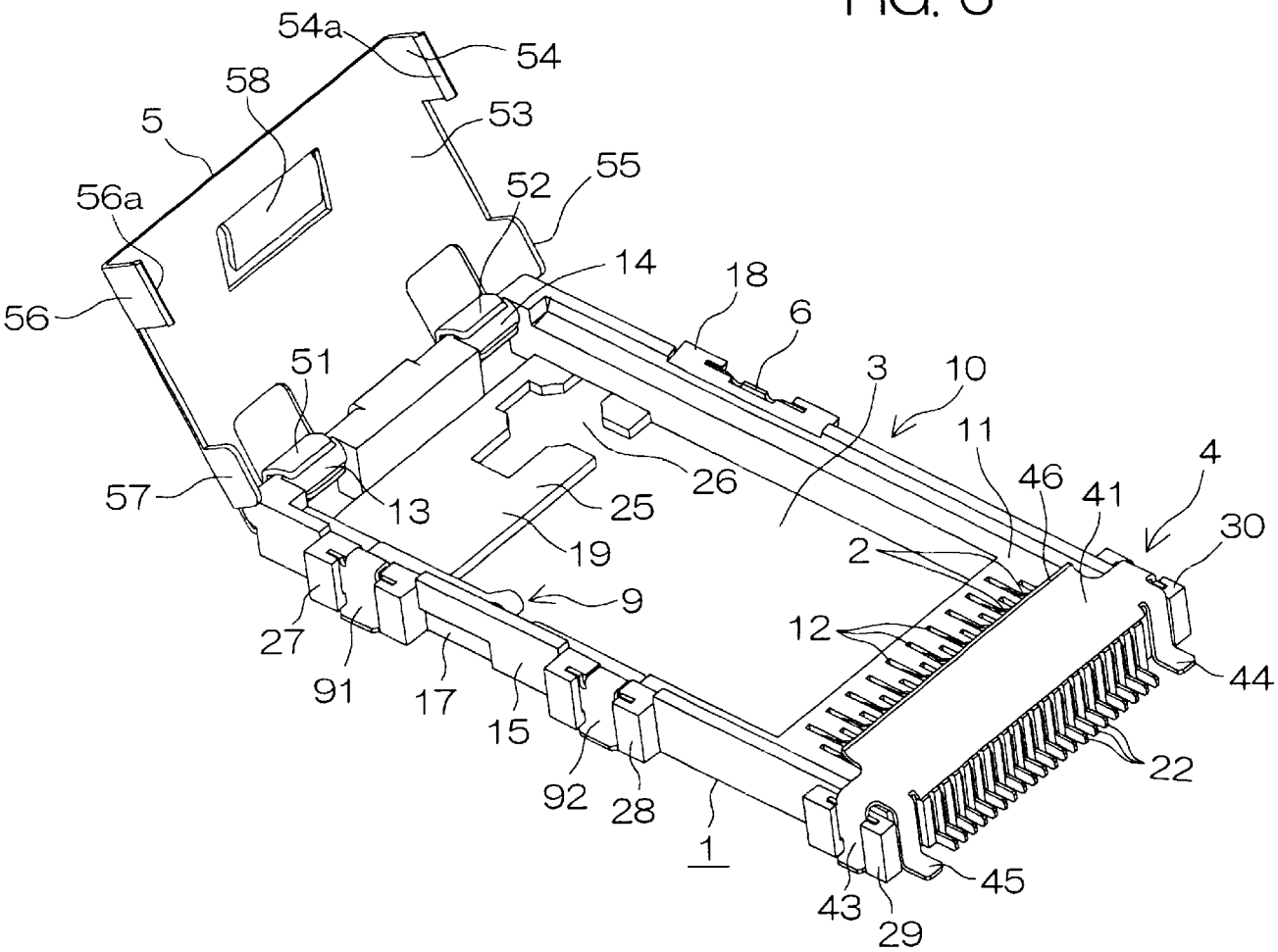
FIG. 6 is a perspective view of the connector in FIG. 1, illustrating the state in which a coaxial connector is not mounted.

Formed in the vicinity of the cover-member mounting shafts 13, 14 is a high-frequency-signal connector-element mounting portion 19 on which a coaxial connector 7 serving as a high-frequency-signal connector element can be mounted by press fit. The high-frequency-signal connector-element mounting portion 19 has a plate-like member 25 defining the module mounting space 3, and a notch serving as a coaxial-connector press-fit portion 26 is formed in the plate-like member 25 as passing therethrough. The shape of the coaxial-connector press-fit portion 26 is shown in FIG. 6 illustrating the state in which the coaxial connector 7 is not being mounted.

The coaxial connector 7 will be discussed in detail later. In short, the coaxial connector 7 has a signal contact 71 at the center and a cylindrical ground contact 72 disposed as surrounding the signal contact 71. The signal contact 71 and the ground contact 72 are resiliently biased upwardly in FIGS. 1 and 2 by means to be discussed later.

A switch member 9 for detecting the presence/absence of a communication module is disposed in the module mounting space 3 at a position near the one lateral side 15 of the connector body 1. The switch member 9 has a pair of contacts 91, 92 each made of a resilient metallic piece. The base ends of the contacts 91, 92 are respectively pressed into contact press-fit portions 27, 28 formed as projecting from the lateral side 15 of connector body 1. The base ends of the contacts 91, 92 hang down along the lateral side 15 of the connector body 1 and reach the vicinity of the bottom of the connector body 1. These base ends will be solder-joined to the wiring pattern on the assembled circuit board.

This embodiment is arranged such that, when a communication module is mounted on the module mounting space 3, one contact 91 is resiliently deformed to come in contact with the other contact 92, causing the switch member 9 to be conducted. When no communication module is mounted on the module mounting space 3, the contacts 91, 92 are kept as opened. Accordingly, the presence/absence of a communication module can be detected by detecting the conduction/non-conduction of the switch member 9 at the side of the apparatus.

Figure 3:
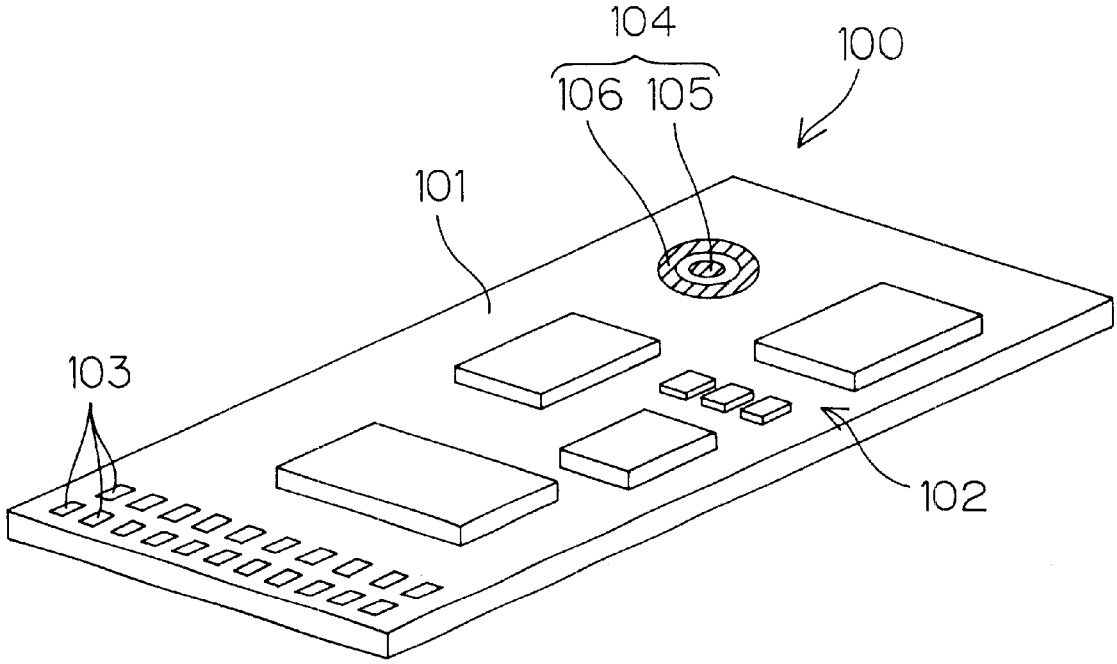
FIG. 3 is a simplified perspective view of an example of a communication module to be mounted on the connector in FIG. 1.

FIG. 3 is a simplified perspective view of an example of a communication module 100 to be mounted on the connector 10 having the arrangement above-mentioned. This communication module 100 is a bluetooth transmission/reception module comprising a circuit board 101 and a plurality of circuit elements which are mounted on the circuit board 101 and form a high frequency circuit 102. The circuit board 101 is made substantially in the form of a rectangular card. Formed along a shorter side at one end side of the circuit board 101 are ordinary signal metallic pads 103 for communicating a signal of an ordinary frequency band with the assembled circuit board of the apparatus. The metallic pads 103 are for example formed by exposing, to the outside, portions of the metallic wiring pattern on the circuit board 101. The metallic pads 103 are formed in a plural number in zigzags corresponding to the zigzag arrangement of the contacts 21 of the contact members 2 of the connector 10.

Formed at the other end (opposite to the metallic pads 103) of the circuit board 101 is a high-frequency-signal terminal portion 104 so as to match the disposition of the coaxial connector 7 mounted on the connector body 1. The high-frequency-signal terminal portion 104 has a high-frequency-signal metallic pad 105 and an annular ground metallic pad 106 surrounding the same. The metallic pads 105, 106 may be formed by exposing, to the outside, portions of the wiring conductors formed on the circuit board 101.

Figure 4:
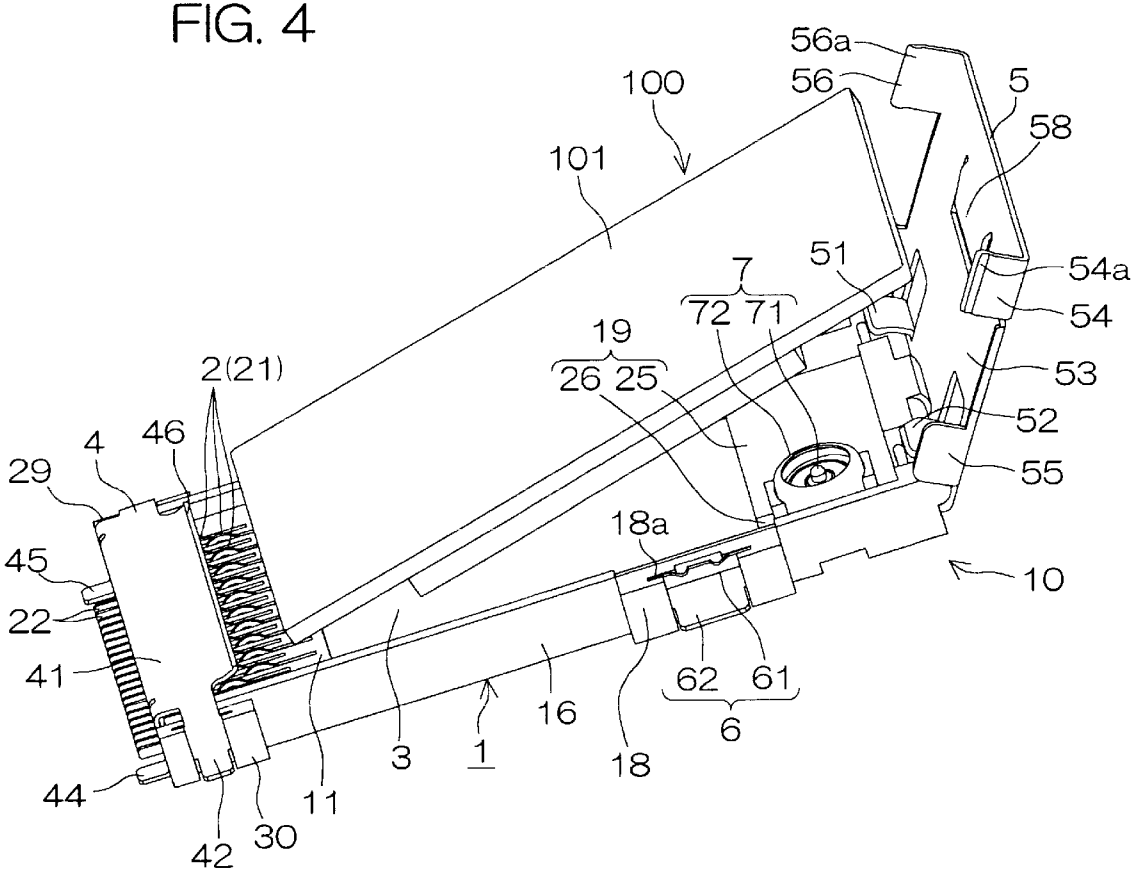
FIG. 4 is a perspective view illustrating the state in which a communication module is on the way in its installation on the connector in FIG. 1.
Figure 5:
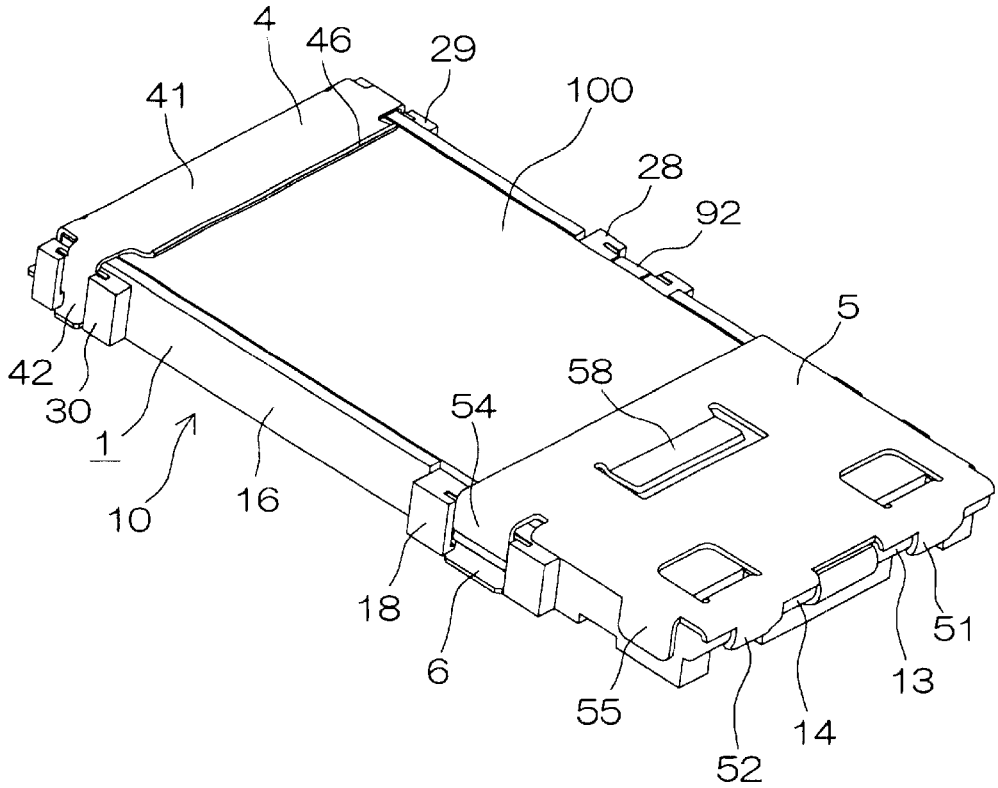
FIG. 5 is a perspective view illustrating the state in which the installation of the communication module on the connector in FIG. 1 is completed.

FIG. 4 is a perspective view illustrating the state in which the communication module 100 is on the way in its installation on the connector 10, and FIG. 5 is a perspective view illustrating the state in which the installation of the communication module 100 on the connector 10 is completed. The communication module 100 is mounted, with the bottom up, on the module mounting space 3 with the metallic pads 103 and the metallic pads 105, 106 (FIG. 3) turned to the contact members 2 and the coaxial connector 7, respectively. More specifically, the communication module 100 is positioned such that the end at the side of the metallic pads 103 corresponds to the side of the contact members 2 and that the metallic pads 105, 106 correspond to the side of the coaxial connector 7. Then, the end at the side of the metallic pads 103 is inserted into the space between the regulating member 4 and the bottom surface 11. An upwardly curved guide portion 46 is formed at the edge of the regulating member 4 at the side of the module mounting space 3. This guide portion 46 is arranged to smoothly guide one end of the communication module 100 inserted obliquely from above, to the space under the regulating member 4.

When one end of the communication module 100 is inserted into the space between the regulating member 4 and the bottom surface 11, the other end of the communication module 100 is pushed into the module mounting space 3. At this time, the other end of the communication module 100 comes in contact with the tips of the rotational mounting portions 51, 52 of the cover member 5. When the communication module 100 is further pushed into the module mounting space 3, the communication module 100 gives moment in the cover closing direction to the cover member 5 through the rotational mounting portions 51, 52. This means that the installation operation of the communication module 100 causes the cover member 5 to start rotating in the closing direction. After the communication module 100 has been pushed into the module mounting space 3, the user further rotates the cover member 5 in the closing direction such that the locking portions 54*a*, 56*a* are respectively engaged with the step portion 61 of the heat transfer member 6 and the locking concave portion 17 against the resilient biasing force of the coaxial connector 7. This provides a closing state shown in FIG. 5.

In this state, the metallic pads 103 of the communication module 100 come in resilient contact with the contacts 21 of the contact members 2. This contact state is kept by the fact that the one end of the communication module 100 is regulated by the regulating member 4. On the other hand, at the other end of the communication module 100, the metallic pads 105, 106 respectively come in resilient contact with the signal contact 71 and the ground contact 72 of the coaxial connector 7. This contact state is kept by the fact that the cover member 5 is locked in the closing state.

The heat transfer member 6 arranged to be contacted with the cover member 5 through the locking portion 54*a* as discussed in the foregoing, is joined to the ground potential portion of the assembled circuit board. Accordingly, the cover member 5 made of a metallic material is provided with a noise shielding function. More specifically, the cover member 5 can shield electromagnetic noise which is externally exerted to the high frequency circuit 102 on the communication module 100 positioned inside of the cover member 5. The cover member 5 is provided in the vicinity of the rotational mounting portions 51, 52 with the hanging portions 55, 57. These hanging portions 55, 57 cover the module mounting space 3 laterally, thus contributing to an increase in noise shielding function.

Figure 7:
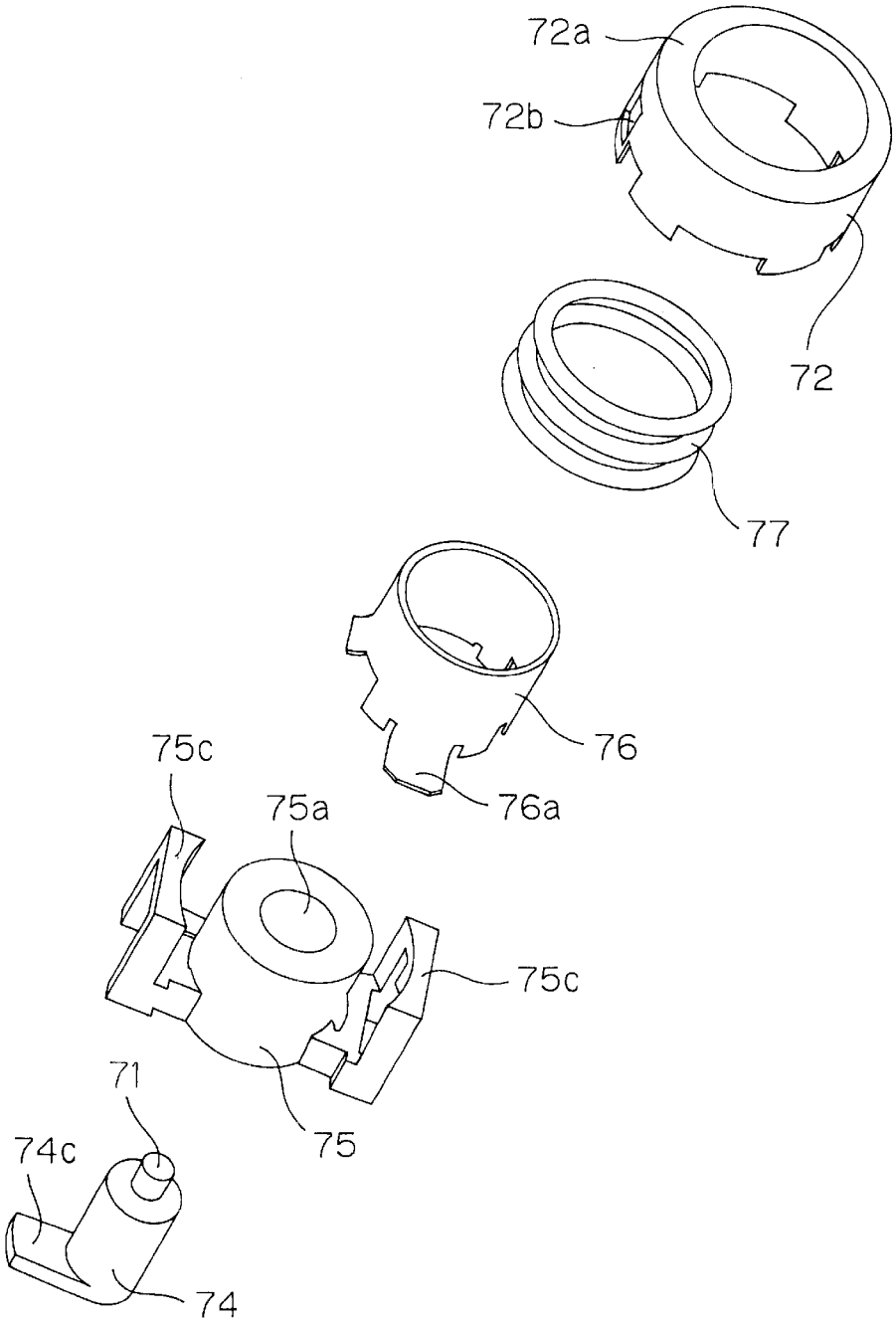
FIG. 7 is an exploded perspective view of a coaxial connector.
Figure 8:
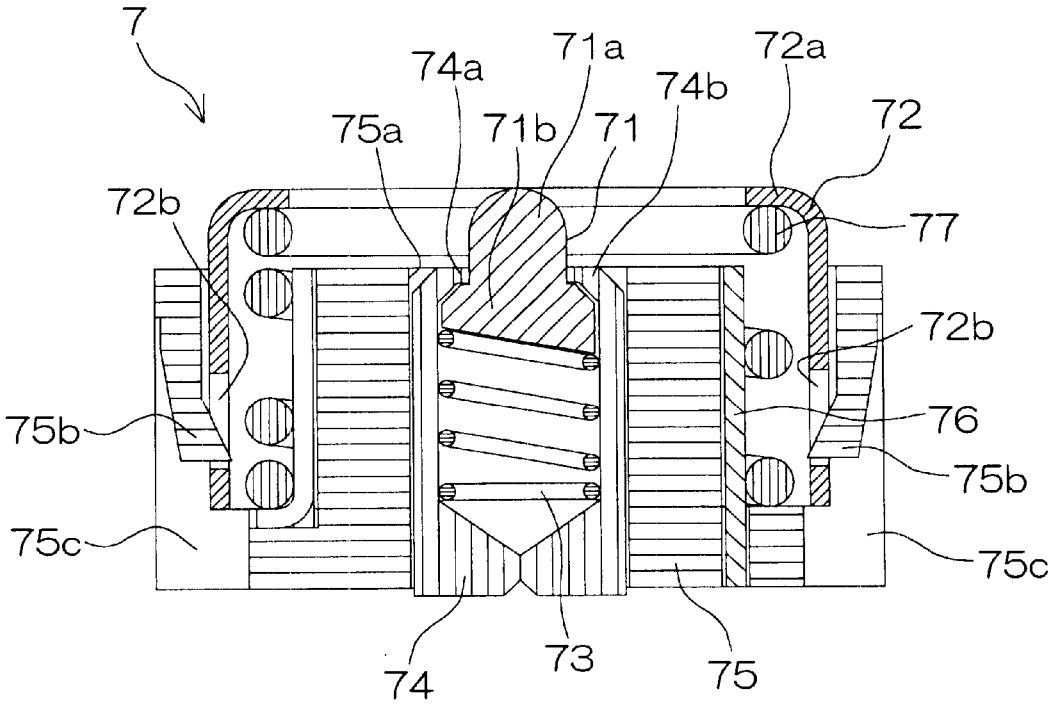
FIG. 8 is a vertical section view of the coaxial connector in FIG. 7.

FIG. 7 is an exploded perspective view of the coaxial connector 7, and FIG. 8 is a vertical section view of FIG. 7. The coaxial connector 7 has the signal contact 71, a signal-contact coiled spring 73 for resiliently upwardly biasing the signal contact 71, a holding casing 74 which houses the signal contact 71 and the signal-contact coiled spring 73, and a housing 75 for holding the holding casing 74 and the ground contact 72.

The housing 75 is made of a resin molded article, and is provided in the center thereof with a press-fit hole 75*a* into which the holding casing 74 is pressed. A metallic ground connection member 76 is fitted on the substantially cylindrical outer periphery of the housing 75. The ground connection member 76 is also substantially cylindrical and is provided at the lower end edge thereof with a solder-joint portion 76*a* as projecting outwardly, which is to be solder-joined to the assembled circuit board.

A ground-contact coiled spring 77 for resiliently upwardly biasing the ground contact 72, is disposed on the outer periphery of the ground connection member 76. This ground-contact coiled spring 77 is made of metal for electrically connecting the ground contact 72 and the ground connection member 76 to each other. The ground contact 72 is provided at the upper end thereof with an inwardly turned flange 72*a*. This flange 72*a* is arranged to come in contact with the upper end of the ground-contact coiled spring 77.

The ground contact 72 is provided in the lower portion thereof with at least two locking engagement holes 72*b* with an interval in the peripheral direction provided therebetween. Locking pawls 75*b* formed integrally with the housing 75 are arranged to engage with these locking engagement holes 72*b*, thus regulating the upward displacement of the ground contact 72 against the biasing force of the ground-contact coiled spring 77. The locking pawls 75*b* are formed as hanging down from the top rods of frame portions 75*c* which project outwardly from the lower end of the housing 75 and then stand upwardly.

When the ground connection member 76 is put on the housing 75 and the ground-contact coiled spring 77 is disposed on the ground connection member 76 and the ground contact 72 is pushed towards the housing 75, the lower end of the ground contact 72 is guided by inclined guiding surfaces formed at the inner sides of the locking pawls 75*b*. This causes the locking pawls 75*b* to be resiliently outwardly deformed. When the ground contact 72 is further pushed in, the locking pawls 75*b* enter, by their restoring force, into the locking engagement holes 72*b*. In this state, the lower end faces of the locking pawl s 75*b* which are substantially horizontal locking faces, are opposite to the lower end faces of the locking engagement holes 72*b*, thus preventing the ground contact 72 from coming out.

The signal contact 71 has a projecting portion 71*a* which projects outwardly (upwardly) through a through-hole 74*a* in the upper end of the holding casing 74, and a shoulder portion 71*b* held in the space inside of the holding casing 74 by an inwardly turned flange 74*b* formed at the upper end of the holding casing 74. The lower face of the shoulder portion 71*b* is inclined with respect to the axis of the holding casing 74. The signal-contact coiled spring 73 comes in contact with this inclined lower face. The signal-contact coiled spring 73 is housed, as compressed, in the holding casing 74. Accordingly, unless an external force is exerted, the projecting portion 71*a* of the signal contact 71 is kept as projecting upwardly above the holding casing 74.

Each of the signal contact 71, the signal-contact coiled spring 73 and the holding casing 74 is made of a metallic material. As shown in FIG. 7, the holding casing 74 has a solder-joint portion 74*c* projecting from the lower end of the holding casing 74. This solder-joint portion 74*c* is to be soldered to the assembled circuit board. Accordingly, the signal contact 71 is electrically connected to the holding casing 74 through the coiled spring 73, and then electrically connected to the assembled circuit board through the holding casing 74.

By using the coaxial connector 7 having the arrangement above-mentioned, the signal contact 71 and the ground contact 72 can independently be resiliently biased. This assures good electrical connection between the signal contact 71 & the ground contact 72, and the metallic pads 105, 106 on the communication module.

Figure 9:
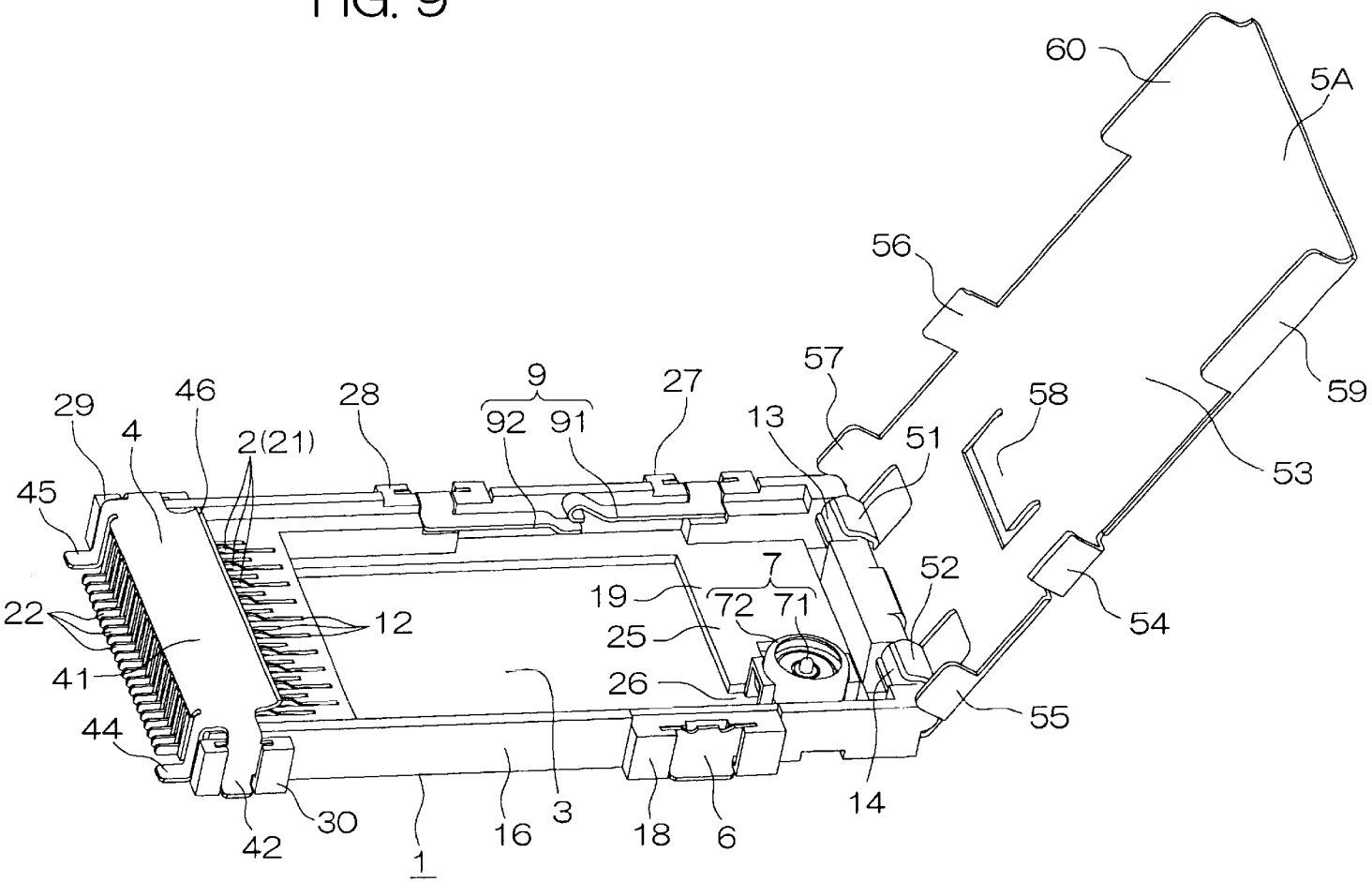
FIG. 9 is a perspective view of a connector according to another embodiment of the present invention.

In the foregoing, an embodiment of the present invention has been discussed. However, the present invention can also be embodied in a different manner. For example, the embodiment above-mentioned is arranged such that the cover member 5 does not cover the whole module mounting space 3, but covers only a portion, near the coaxial connector 7, of the module mounting space 3. However, as shown in FIG. 9, there may be used a cover member 5A having sizes which cover the whole module mounting space 3. When such large cover member 5A is used, there can be expected not only a greater heat radiating effect, but also an external noise shielding effect. The large cover member 5A in FIG. 9 has hanging portions (reinforcing tabs) 59, 60 which hang down from the main body 53, at both sides of the tip to be located in the vicinity of the contact members 2 when the cover member 5A is closed. This further improves the noise shielding effect.

For the arrangement in FIG. 9, it is required to assure a large space for opening and closing the large cover member 5A. Accordingly, when the cover-member opening/closing space is limited, the small cover member 5 shown in the embodiment above-mentioned is preferably used.

In FIG. 9, like parts are designated by like reference numerals used in FIG. 1 to FIG. 8.

Figure 10:
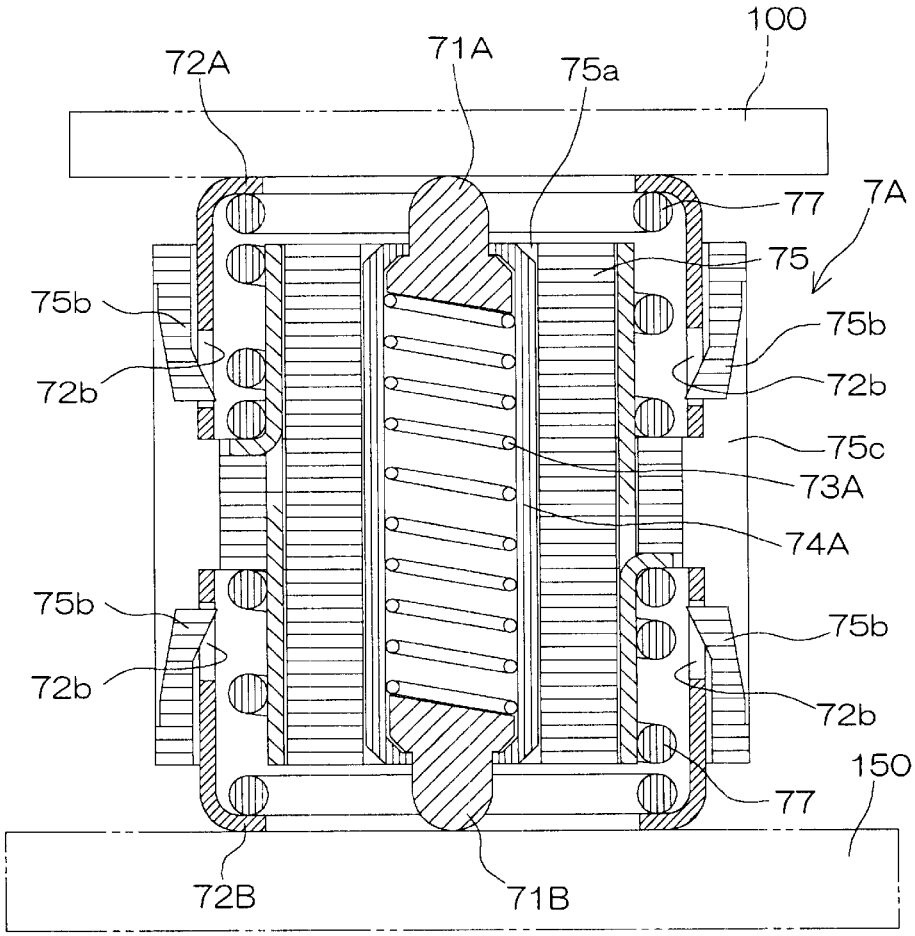
FIG. 10 is a vertical section view of another example of the coaxial connector.

In the embodiment above-mentioned, the coaxial connector 7 is solder-joined to the assembled circuit board. However, provision may be made such that there is used a coaxial connector 7A having a substantially vertically symmetrical arrangement as shown in FIG. 10. That is, a signal contact 71A and a ground contact 72A are resiliently pressingly contacted with a communication module 100, and a signal contact 71B and a ground contact 72B are resiliently pressingly contacted with an assembled circuit board 150. In this arrangement, the signal contacts 71A, 71B are held by a common holding casing 74A and resiliently biased in opposite directions by a single compression coiled spring 73A housed in the holding casing 74A. In FIG. 10, like parts are designated by like reference numerals used in FIG. 8.

In the embodiment above-mentioned, the description has been made of the connector used with a coaxial connector mounted thereon. However, when the communication module incorporates an antenna, no coaxial connector is required to be mounted on the connector. In such a case, the connector maybe used in the state shown in FIG. 6. More specifically, the connector 10 in the embodiment above-mentioned may be used for both a communication module using an external antenna and a communication module incorporating an antenna.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This application corresponds to Japanese Patent Application Serial No. 2000-397215 filed on Dec. 27, 2000 with Japanese Patent Office, the disclosure of which is incorporated herein by reference.

What we claim is:

1. A communication module connector to be used for mounting, on an assembled circuit board, a communication module having a high frequency circuit mounted thereon, said communication module connector comprising:

a connector body to be mounted on said assembled circuit board, the connector body including a base panel extending longitudinally and laterally, a pair of opposite side walls connected to the base panel and extending longitudinally and transversely to define an internal module mounting space;

a plurality of contact members disposed in a juxtaposed manner relative to one another and extending longitudinally at one end of the connector body on the base panel in the module mounting space, the contact members having contacts which come in resilient contact with terminals of said communication module, and a plurality of connection portions which are to be electrically connected to said assembled circuit board and each one being integrally connected to respective ones of the contact members and extending longitudinally to project exteriorly from the module mounting space; and a high-frequency-signal connector-element mounting portion formed into the base panel, disposed in the module mounting space and spaced apart longitudinally from the contact members for mounting a high-frequency-signal connector element.

2. A communication module connector according to claim 1, wherein said connector body has a mounting space on which said communication module is to be mounted, and wherein said communication module connector further comprises a cover member for opening and closing at least a portion of said mounting space.

3. A communication module connector according to claim 2, further comprising a locking mechanism for keeping said cover member in a closing state.

4. A communication module connector according to claim 2, wherein said cover member is rotatably attached to one end of said connector body for regulating one end portion of said communication module within said mounting space, and there is provided, at the other end of said connector body opposite to said one end, a regulating member arranged to engage with the other end portion of said communication module opposite to said one end portion, thereby to regulate said other end portion of said communication module within said mounting space.

5. A communication module connector according to claim 4, wherein said high-frequency-signal connector-element mounting portion is disposed at said one end of said connector body, and said contact members are disposed at said other end of said connector body.

6. A communication module connector according to claim 2, wherein said cover member is made of metal.

7. A communication module connector according to claim 6, wherein said high-frequency-signal connector-element mounting portion is disposed so as to be covered with said cover member.

8. A communication module connector according to claim 6, further comprising a noise-shielding connection member arranged to connect said cover member to a low-impedance portion of said assembled circuit board when said cover member is closed.

9. A communication module connector according to claim 6, wherein extension portions are formed at a lateral side of said cover member for laterally covering a portion of said mounting space.

10. A communication module connector according to claim 6, wherein said cover member has a spring piece to be pressingly contacted with said communication module.

11. A communication module connector to be used for mounting, on an assembled circuit board, a communication module having a high frequency circuit mounted thereon, said communication module connector comprising:

a connector body to be mounted on said assembled circuit board, said connector body having a mounting space on which said communication module is to be mounted, contact members disposed on said connector body and having contacts which come in resilient contact with terminals of said communication module, and connection portions which are to be electrically connected to said assembled circuit board;

a high-frequency-signal connector-element mounting portion disposed at said connector body for mounting a high-frequency-signal connector element;

a cover member fabricated from metal for opening and closing at least a portion of said mounting space, said cover member having a spring piece to be pressingly contacted with said communication module; and a heat transfer member attached to said connector body, said heat transfer member being arranged to be pressingly contacted with said cover member and to be joined to said assembled circuit board to form a heat radiating passage thereto when said cover member is closed.

12. A communication module connector to be used for mounting, on an assembled circuit board, a communication module having a high frequency circuit mounted thereon, said communication module connector comprising:

a connector body to be mounted on said assembled circuit board, said connector body having a mounting space on which said communication module is to be mounted, contact members disposed on said connector body and having contacts which come in resilient contact with terminals of said communication module, and connection portions which are to be electrically connected to said assembled circuit board;

a high-frequency-signal connector-element mounting portion disposed at said connector body for mounting a high-frequency-signal connector element;

a cover member fabricated from metal for opening and closing at least a portion of said mounting space, said cover member having a spring piece to be pressingly contacted with said communication module; and a heat transfer member attached to said connector body, said heat transfer member being arranged to be pressingly contacted with said cover member and to be joined to a low-impedance portion of said assembled circuit board to form a heat radiating passage thereto when said cover member is closed, said heat transfer member also serving as a noise-shielding connection member.

13. A communication module connector according to claim 2, further comprising a mounting aid member which is disposed at a rotational base end of said cover member, which comes in contact with one end of said communication module at the time of operation of mounting the same on said mounting space, and which causes said cover member to be rotated in the closing direction when said communication module is pushed into said mounting space.

14. A communication module connector to be used for mounting, on an assembled circuit board, a communication module having a high frequency circuit mounted thereon, said communication module connector comprising:

a connector body to be mounted on said assembled circuit board;

contact members disposed on said connector body and having contacts which come in resilient contact with terminals of said communication module, and connection portions which are to be electrically connected to said assembled circuit board;

a high-frequency-signal connector-element mounting portion disposed at said connector body for mounting a high-frequency-signal connector element; and a switch member disposed at said connector body, said switch member being arranged to be made or opened dependent on an installation of said communication module.

15. A communication module connector according to claim 1, further comprising a high frequency-signal connector element mounted on said high-frequency-signal connector-element mounting portion and arranged to come in resilient contact with a high-frequency-signal terminal portion of said communication module.

16. A communication module connector to be used for mounting, on an assembled circuit board, a communication module having a high frequency circuit mounted thereon, said communication module connector comprising:

a connector body to be mounted on said assembled circuit board;

contact members disposed on said connector body and having contacts which come in resilient contact with terminals of said communication module, and connection portions which are to be electrically connected to said assembled circuit board;

a high-frequency-signal connector-element mounting portion disposed at said connector body for mounting a high-frequency-signal connector element; and a high-frequency-signal connector element mounted on said high-frequency-signal connector-element mounting portion and arranged to come in resilient contact with a high-frequency-signal terminal portion of said communication module, wherein said high-frequency-signal connector element includes:

a ground contact arranged to come in contact with a ground portion of said high-frequency-signal terminal portion;

a signal contact arranged to come in contact with a signal portion of said high-frequency-signal terminal portion;

a ground contact biasing member for resiliently biasing said ground contact to said ground portion of said high-frequency-signal terminal portion; and a signal contact biasing member for resiliently biasing said signal contact to said signal portion of said high-frequency-signal terminal portion.

* * * * *